United States Patent [19]

LeFever

[11] 4,230,450

[45] Oct. 28, 1980

[54] INTRUSION ALARM SAFETY

[75] Inventor: Randall H. LeFever, Williamsport, Pa.

[73] Assignee: GTE Products Corporation, Stamford, Conn.

[21] Appl. No.: 36,126

[22] Filed: May 4, 1979

[51] Int. Cl.[3] ..... G08B 3/14; G08B 7/08; G08B 13/08

[52] U.S. Cl. ..... 431/361; 116/5; 116/7; 116/87; 116/88

[58] Field of Search ..... 431/361, 362, 358, 357, 431/365; 116/87, 88, 5, 7, 15

[56] References Cited

U.S. PATENT DOCUMENTS

| | | | |
|---|---|---|---|
| 3,714,647 | 1/1973 | Litman | 340/416 |
| 3,805,257 | 4/1974 | Litman | 340/416 |
| 4,060,372 | 11/1977 | Beck | 431/361 |
| 4,116,615 | 9/1978 | Hall | 431/361 |
| 4,130,081 | 12/1978 | Blaisdell | 116/7 |
| 4,130,082 | 12/1978 | Bouchard | 116/7 |
| 4,130,083 | 12/1978 | Bouchard | 116/7 |

FOREIGN PATENT DOCUMENTS

| | | | |
|---|---|---|---|
| 518 | of 1880 | United Kingdom | 116/87 |

*Primary Examiner*—Gerald Goldberg
*Assistant Examiner*—Denis E. Corr
*Attorney, Agent, or Firm*—Lawrence R. Fraley

[57] ABSTRACT

A mechanism for activating a plurality of flashlamps in a flashlamp article (e.g., MAGICUBE) in response to external actuation (e.g., the opening or closing of a door) thereof. To prevent accidental actuation, the mechanism includes a safety device in the form of an elongated pin which inserts within a pair of aligned openings within the mechanism to positively engage and retain the mechanism's movable activator. In one embodiment, the pin is also attached via a cord to the mechanism's spherical ball engagement member which causes movement of the activator.

9 Claims, 4 Drawing Figures

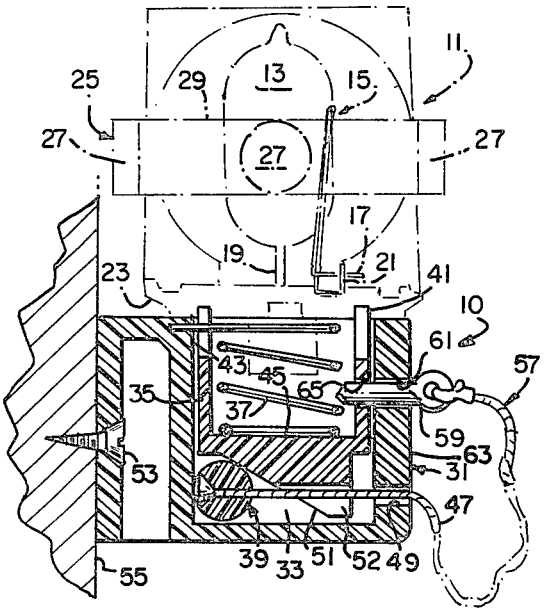
FIG. 1
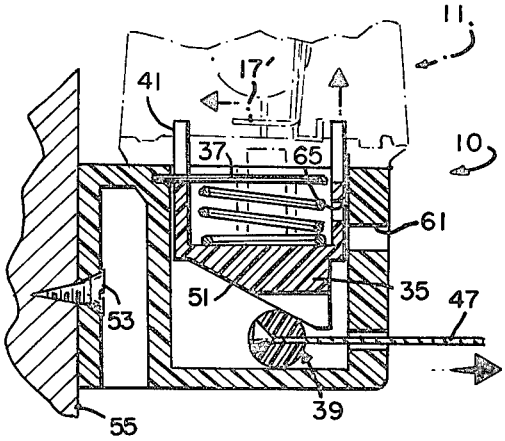
FIG. 2
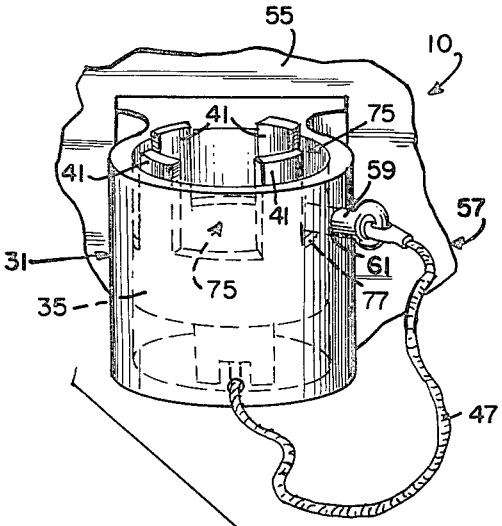
FIG. 3
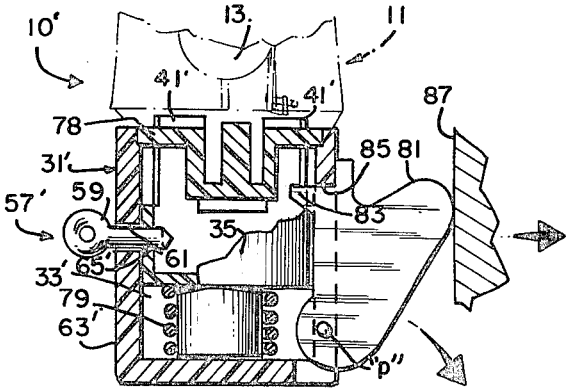
FIG. 4
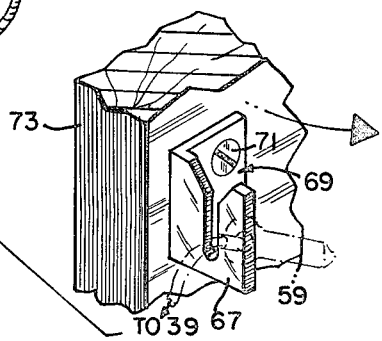

INTRUSION ALARM SAFETY

BACKGROUND OF THE INVENTION

The invention relates to activating mechanisms and particularly to activating mechanisms which function in response to some form of external actuation, e.g., the opening or closing of a window or door. As can be appreciated, such mechanisms are particularly applicable to alarm systems.

In U.S. Pat. No. 4,130,082 (A. C. Bouchard et al), there is described a multilamp flashlamp assembly which is capable of emitting both highly intense audible and visual signals when actuated by some external means, e.g. a door closing. In operation, the assembly's flashlamp component is triggered by a plurality of upwardly moving engagement members which release a corresponding plurality or prestressed striker springs. These springs in turn strike the projecting primer tubes of the assembly's percussive flashlamps to effect ignition thereof. The resulting high intensity flashes activate a series of hermetically-sealed conbustible members, e.g. pyrotechnics, located relative to the flashlamps to produce the desired audible ouputs. The highly intense noise emitted from the pyrotechnic may serve two purposes: (1) to scare away a prospective intruder; and (2) to trigger a suitable sound detector located within range of the pyrotechnic, which may then function to emit a continuous warning signal or perform additional, related functions. U.S. Pat. No. 4,130,082 is assigned to the assignee of the instant invention.

In U.S. Pat. No. 4,130,081 (R. G. Blaisdell et al) and 4,130,083 (A. C. Bouchard et al), both of which are also assigned to the assignee of this invention, there are described various embodiments of mechanisms which are capable of activating the assembly of U.S. Pat. No. 4,130,082 and which represent improvements over the activating mechanism described therein. The mechanism of U.S. Pat. No. 4,130,081 provides activation as a result of an increase in tension on a cord member projecting therefrom and secured to an engaging component, e.g. spherical ball, located within the mechanism's casing. The spherical ball mates with an angular surface on the mechanism's activator to force the activator upward when the aforedescribed tension increase occurs. A helical spring within the casing assures return of the activator subsequent to activation of the flashlamp article.

The mechanism of U.S. Pat. No. 4,130,083 operates differently from that of U.S. Pat. No. 4,130,081 in that the activator component is continuously biased upward and will thus rapidly move to effect article activation upon release thereof. Retention of the activator is provided by a pivotal arm which extends within the casing to engage said member. Activator disengagement and release occurs when an external surface, e.g. door, against which the pivotal arm was positioned moves away from the casing with the arm pivoting as a result thereof.

The present invention represents yet another improved means for activating flashlamp articles similar to those described in U.S. Pat. No. 4,130,082 and particularly is concerned with improving the devices defined in U.S. Pat. Nos. 4,130,081 and 4,130,083 providing safety means for preventing accidental activation thereof during periods of handling, installation, etc. Accidental ignition not only results in an unnecessary waste of material but also may prove inconvenient to the system's user in the event an accompanying detector is utilized in that it would be necessary for the user to reset the detector.

It is believed therefore that an improved activation means possessing the capability defined above would constitute a significant advancement in the art.

OBJECTS AND SUMMARY OF THE INVENTION

It is therefore a primary object of the present invention to enhance the flashlamp article activation art by providing an activation means possessing the above desired feature. It will also be understood from the following detailed description that the present invention possesses other features desired of such devices, including means for providing assurance that the device, when installed, cannot be inadvertently left in a locked, non-firing position.

According to one aspect of the invention, there is provided an activation means which comprises a casing, an activator capable of occupying both firing and non-firing positions within the casing, biasing means for continuously biasing the activator toward the non-firing position, and engagement means which, when actuated by external means, causes the activator to move to the firing position whereupon activation of the flashlamp article is accomplished. The activation means also comprises a safety means which includes a retention member for being positioned within an opening in the casing to engage and retain the activator in the non-firing position. The retention member is secured to the engagement means, e.g. spherical member, thus preventing its loss during shipping, storage, etc. This feature also prevents the installed flashlamp article-activation means assembly from being left in a non-firing position when the retention member is further utilized with a holder component attached to a second surface remotely located and separate from the surface to which the assembly's casing is secured.

According to another aspect of the invention, there is provided an activation means which comprises a casing, an activator for occupying firing and non-firing positions within the casing, means for effecting movement of the activator from the non-firing to the firing position, and a pair of retention members which function in a cooperative manner to retain the activator in the non-firing position and assure its eventual release whereupon the activator can be moved to the firing position and the flashlamp article ignited. One of the retention members acts as a safety means to prevent activator movement even in the event that the remaining retention member effects release of the activator. This feature assures that the assembly can be safely installed in the desired location without possible accidental activation. Once the assembly is installed, the safety is removed.

BRIEF DESCRIPTION OF THE DRAWINGS

FIGS. 1 and 2 are side elevational views of a preferred embodiment of the invention illustrating firing and non-firing positions thereof;

FIG. 3 is a perspective view and represents an alternate embodiment of the invention; and FIG. 4 is a side elevational view illustrating yet another embodiment of the present invention.

DETAILED DESCRIPTION OF THE PREFERRED EMBODIMENTS

For a better understanding of the present invention together with other and further objects, advantages and capabilities thereof, reference is made to the following disclosure and appended claims in connection with the above-described drawings.

With particular reference to FIGS. 1 and 2, there is shown an activation means 10 in accordance with one embodiment of the invention. Means 10 is adapted for activating a flashlamp article 11 (shown in phantom) which is preferably a multilamp photoflash article currently available on the market under the name "MAGICUBE". This well known and highly reliable article is produced and sold under said name by the assignee of the present invention, GTE Sylvania Incorporated. Typically, article 11 includes four percussively-ignitable flashlamps 13 (one shown) and a prestressed striker spring 15 associated therewith. Spring 15 includes a striker arm 17 which moves to strike and deform the primer 19 of lamp 13 when released from its retained position, said retention maintained by an upstanding element 21. Arm 17 is shown in the striking position by numeral 17' in FIG. 2.

Spring 15 and primer 19 are preferably mounted within a base portion 23 of article 11. As defined in U.S. Pat. No. 4,130,082, article 11 can further include at least one combustible member 25 positioned in operative relationship to one of the flashlamps 13 for receiving the energy therefrom in the form of light and/or heat. Accordingly, combustible member 25 will provide a highly intense audible signal in response to receipt of this energy. Member 25 comprises at least one pyrotechnic device 27 located adjacent each lamp 13. According to one embodiment defined in U.S. Pat. No. 4,130,082, each device 27 may be positioned in a closed strap 29 which encompasses the body of the flashlamp article.

An example of pyrotechnic devices 27 suitable for use with the invention are those available on the market uner the name "SUPER BANG CAPS", which are currently distributed by the Ohio Art Company, Bryan Ohio. Each of these caps contains a pyrotechnic composition of potassium chlorate, red phosphorus, manganese dioxide, sand, and glue. The content of each cap is less than 0.20 grains. Pyrotechnic compositions known as "Armstrong's Mixtures" may also be used with the present invention. These compositions typically include potassium chlorate within the range of about 67 to 81 percent, phosphorous from about 8 to 27 percent, sulfur from about 3 to 9 percent, and precipitated chalk from about 3 to 11 percent. Other formulations are of course possible. The cap is hermetically sealed separately from the activating flashlamp.

Activation means 10 comprises a casing 31 which defines a chamber 33 therein, an activator 35 movably oriented with chamber 33, biasing means 37 for biasing activator 35 to a first, non-firing position, and engagement means 39 for engaging activator 35 to cause it to move from the first, non-firing position to a second position. This second position (shown in FIG. 2) represents the firing position for means 10 wherein an upstanding engagement member 41 on activator 35 has moved to engage and release a respective striking arm 17 on spring 15. Release of arm 17 effects successful firing of the flashlamp 13 associated therewith.

As shown in FIG. 3, activator 35 includes four members 41 when the activator is used to fire a flashlamp article 11 containing four flashlamps 13 therein.

As illustrated, activation of article 11 occurs when the article is positioned atop casing 31. Biasing means 37 preferably comprises a helical spring secured at one end to a wall 43 of casing 31 and engaged at the opposing end to an internal surface 45 of activator 35 to act thereagainst. It is of course within the scope of the invention to employ other types of biasing members, including such resilient elements as sponges, rubber articles, and cantilever strips (secured at one end within wall 43). Engagement means 39 preferably comprises a spherical member having a cord 47 attached thereto. Cord 47 extends from casing 31 through a hole 49 and when tension is applied thereto (FIG. 2), moves spherical member 39 across an angular end surface 51 of activator 35 to force upward movement thereof. Activator 35 includes a slot 52 therein to accommodate cord 47.

Means 10 may further include a screw 53 for securing casing 31 to an external surface 55, e.g. wall, door, or door casing. Other forms of attachment, e.g. two-sided tape, could also be used to secure casing 31.

The parts of the activation means as described above are substantially identical and operate in a similar manner to those defined in U.S. Pat. No. 4,130,081. The present invention, however, represents a significant improvement over the device of U.S. Pat. No. 4,130,081 by additionally providing a safety means 57 which serves to positively engage and retain activator 35 in the first, non-firing position despite the aforedescribed increased tension on cord 47. Safety means 57 comprises a retention member 59, e.g. an elongated pin, which is capable of being inserted within an opening 61 located within a side wall 63 of casing 31. An aperture 65 is also provided within activator 35 whereupon pin 59, when inserted within opening 61, will extend through wall 63 and enter the aperture. Both opening 61 and aperture 65 are coaxially aligned to receive pin 59 during activator retention in the non-firing position shown in FIG. 1. As also shown in FIG. 1, pin 59 is secured to spherical member 39 by cord 47. This attachment may be simply accomplished by providing an eyelet portion within a protruding end of pin 59 and tying cord 47 thereto.

With pin 59 in position, upward movement of activator 35 is prevented. Accordingly, safety means 57 prevents accidental activation of article 11 in the event of an unintentional pulling on cord 47. This feature thereby also facilitates shipping, handling, etc. of the combined activation means and article assemby should it be desired to transport these components in this manner. Such transportation is even further facilitated in that insertion of pin 59 within casing 31 provides a convenient means of storing this component.

In the embodiment of the invention depicted in FIG. 3, it is preferred to also utilize pin 59 as part of the means for actuating spherical member 39 to effect the aforedescribed movement within casing 31 and across end surface 51. To achieve this, a holder 67 having a slot 69 therein is provided. Holder 67 is attachable, e.g. by screw 71, to a surface separate from that (55) to which casing 31 is attached. For example, if it is desired to utilize the activation means-article assembly as part of an alarm system for detecting the opening of a door, casing 31 may be secured to the door's casing while holder 67 is attached to the door (73 in FIG. 3). Pin 59 is securedly oriented within holder 67 by locating cord 47 within slot 69 such that tension on the cord (as caused by the door opening) results in the pin impacting against the holder. Passage of pin 59 through slot 69 is prevented due to the greater size of this member. It is readily understood that the above holder arrangement represents one of many which are capable of providing the desired results. As an example of an alternative, acceptable emodiment, it is possible to provide pin 59 with various slots, grooves, or protuberances which mate with corresponding surfaces on holder 67 to assure securement of the pin therein. Incorporating pin 59 as part of the external means for actuating spherical member 39 thus assures that the user of the activation means-article assembly cannot inadvertently leave the means locked in the first, non-firing position after installation. This is a possibility when using an internal or independent safety such as the locking means shown in FIG. 6 of U.S. Pat. No. 4,130,081.

The activation means of FIG. 3 also represents another embodiment of the invention in that the need for an aperture within activator 35 for accommodating pin 59 is eliminated. In this embodiment, pin 59 extends through opening 61 and aligns within one of the slots 75 located between and defined by the spaced-apart upstanding members 41. Spring 37, spherical member 39, and article 11 are not shown in FIG. 3 for purposes of clarification. The cylindrical body portion of pin 59 possesses a smaller diameter than the width of slot 75. Insertion of pin 59 within opening 61 thus results in the pin engaging an upper surface 77 on activator 35 to assure the described retention thereof.

In FIG. 4 there is shown an activation means 10' in accordance with yet another embodiment of the invention. Like means 10 above, the activation means 10' of FIG. 4 includes a casing 31' which permits location of the aforedescribed flashlamp article 11 thereon and defines a chamber 33' therein. Positioning of article 11 is facilitated by provision of a seating means 78 which is of a configuration specifically designed to accommodate the projecting parts of known MAGICUBE components. Within chamber 33' is an activator 35' which, unlike activator 35, is continuously biased, e.g. by helical spring 79, upwardly toward the desired firing position. Spring 79 thus provides the means for effecting movement of activator 35'. Activator 35' includes at least one (and preferably four) engagement members 41' thereon which act similarly to members 41 of means 10.

The parts of means 10' as described thus far are substantially similar to those utilized in U.S. Pat. No. 4,130,083. The present invention as shown in FIG. 4, however, represents a substantial improvement over the device in U.S. Pat. No. 4,130,083 by providing a safety means 57' which positively engages and retains activator 35' in the first, non-firing position shown in FIG. 4. Like safety 57 above, safety means 57' comprises an elongated pin 59 which is located within an opening 61' within the side wall 63' of casing 31' and extends therethrough to effect said engagement. An aperture 65' is provided within activator 35' to accommodate pin 59 and thus facilitate retention. As shown, opening 61' and aperture 65' coaxially align during pin insertion. Pin 59 thereby serves as a first retention member to prevent the spring-loaded activator from upward movement. Activation means 10' also includes a second retention member 81 for retaining activator 35' in its non-firing location. Member 81 preferably comprises an arm member which is pivotally oriented on casing 31' (about point "p") and includes a tab 83 which protrudes within slot 85 located within casing 31' opposite pin 59. Slot 85 extends substantially the entire distance of the side of casing 31' and thus accommodates a major portion of arm member 81. Member 81 is designed to rest against a surface 87, e.g. door, such that movement of the door away from casing 31' causes arm 81 to disengage activator 35', thereby effecting release thereof. Unlike the arm in U.S. Pat. No. 4,130,083, however, activator 35' is incapable of upward movement unless pin 59 has been previously removed. The described two retention members thus operate in a cooperative manner, with pin 59 assuring prevention of accidental actuation of means 10' during periods of installation, handling, etc. thereof.

As an alternative to the embodiment of FIG. 4, it is also possible to locate pin 59 within one of the slots defined by engagement members 41, should at least two of these members be utilized.

The preferred material for the invention's casings, activators, retaining arm, holder, spherical member, seating means, and safety members is medium impact polystyrene. The helical springs used in the invention are preferably 0.030 inch diameter music wire. The invention's cord is preferably nylon.

There has thus been shown and described an activation means which includes unique safety features for preventing accidental actuation thereof. In one embodiment, the invention also provides means whereby the device's user cannot properly install the device and inadvertently leave it in a locked, non-firing position.

While there have been shown and described what are at present considered the preferred embodiments of the invention, it will be obvious to those skilled in the art that various changes and modifications may be made therein without departing from the scope of the invention as defined by the appended claims.

What is claimed is:

1. Activation means for activating at least one flashlamp unit located within a flashlamp article, said activation means comprising:

a casing adapted for having said flashlamp article positioned theron, said casing defining a chamber therein and including at least one upstanding side wall having an opening therein;

an activator movably oriented within said chamber of said casing for occupying a first, non-firing position therein, and including an aperture therein and at least one upstanding engagement member thereon, said activator effecting firing of said flashlamp unit within said flashlamp article when said article is positioned on said casing and said activator occupies said second position;

biasing means located within said casing and engaged to said activator for continuously biasing said activator toward said first, non-firing position to return said activator thereto subsequent said firing of said flashlamp unit;

engagement means movably positioned within said chamber of said casing for engaging said activator to effect movement thereof from said first, non-firing position to said second, firing position, said engagement means effecting said movement in response to external actuation thereof; and safety means secured to said engagement means and including a retention member removably positioned within said opening within said side wall of said casing and said aperture within said activator, said retention member positively engaging said activator to retain said activator in said first, non-firing position when said retention member is positioned within said opening and said aperture, said retention member disengaging said activator upon removal of said member from said opening and said aperture to permit said activator to move to said second position in response to said external actuation thereof.

2. The activation means according to claim 1 wherein said engagement means includes a cord affixed thereto having an end portion extending from said casing, said retention member secured to said extending end portion of said cord.

3. The activation means according to claim 1 wherein said aperture and said opening are coaxially aligned during said first, non-firing position.

4. The activation means according to claim 3 wherein said retention member comprises an elongated pin.

5. The activation means according to claim 2 wherein said engagement means further includes a spherical member and said activator includes an end surface established at an angle with respect to the direction of movement of said activator, said spherical member engaging said end surface to effect said movement of said activator in response to an increase in tension on said cord member only when said retention member is removed from said opening within said casing.

6. The activation means according to claim 2 further including means for securing said casing to a first surface, and a holder for being secured to a second surface, said retention member adapted for being securedly oriented within said holder when removed from said opening within said activator, said activation means activating said flashlamp unit in response to relative movement between said first and second surfaces, said relative movement causing an increase in tension on said cord member, said tension increase effecting said external actuation of said engagement means.

7. Activation means for activating at least one flashlamp unit located within a flashlamp article, said activation means comprising:

a casing adapted for having said flashlamp article positioned thereon, said casing defining a chamber therein and including at least one upstanding side wall having an opening therein;

an activator movably oriented within said chamber of said casing for occupying a first, non-firing position and a second, firing position therein, and including an aperture therein and at least one upstanding engagement member theron, said activator effecting firing of said flashlamp unit within said flashlamp article when said article is positioned on said casing and said activator occupies said second position;

means located within said chamber for effecting movement of said activator from said first position to said second position;

safety means including a first retention member removably positioned within said opening within said side wall of said casing and said aperature within said activator, said first retention member positively engaging said activator to retain said activator in said first, non-firing position when said first retention member is positioned within said opening and said aperture, said first retention member disengaging said activator upon removal from within said openings and said aperture; and a second retention member oriented on said casing for retaining said activator in said first, non-firing position and for effecting release thereof in response to actuation by means external of said activation means only when said first retention member is disengaged from said activator.

8. The activation means according to claim 7 wherein said aperture and said opening are coaxially aligned during said first, non-firing position.

9. The activation means according to claim 8 wherein said first retention member comprises an elongated pin.

* * * * *